United States Patent [19]

Yung-Mao

[11] Patent Number: 4,908,962

[45] **Date of Patent: * Mar. 20, 1990**

[54] CUSTOM MIDSOLE FOR HEELED SHOES

[75] Inventor: Lin Yung-Mao, Taichung, China

[73] Assignee: Autry Industries, Inc., Dallas, Tex.

[ * ] Notice: The portion of the term of this patent subsequent to Mar. 29, 2005 has been disclaimed.

[21] Appl. No.: 207,202

[22] Filed: Jun. 16, 1988

Related U.S. Application Data

[63] Continuation-in-part of Ser. No. 153,222, Feb. 8, 1988, which is a continuation-in-part of Ser. No. 25,010, Mar. 12, 1987, Pat. No. 4,733,483.

[51] Int. Cl.[4] ..... A43B 13/14; A43B 13/18; A43B 13/04

[52] U.S. Cl. ..... 36/28; 36/30 R; 36/32 R

[58] Field of Search ..... 36/28, 29, 43, 42, 3 R, 36/3 B, 14, 114, 30 R, 32 R, 15, 100, 101, 107

[56] References Cited

U.S. PATENT DOCUMENTS

| | | | |
|---|---|---|---|
| 886,801 | 5/1908 | Harmon | 36/28 |
| 1,559,532 | 10/1925 | Smith | 36/28 |
| 2,090,881 | 8/1927 | Wilson | 36/29 |
| 2,146,888 | 2/1939 | Fisch | 36/44 X |
| 4,103,440 | 8/1978 | Lawrence | 36/101 |
| 4,319,412 | 3/1982 | Muller | 36/29 |
| 4,481,726 | 11/1984 | Phillips | 36/30 R |
| 4,610,099 | 9/1986 | Signori | 36/28 X |
| 4,676,010 | 6/1987 | Cheskin | 36/32 R |
| 4,733,483 | 3/1988 | Lin | 36/28 |

FOREIGN PATENT DOCUMENTS

| | | | |
|---|---|---|---|
| 0215995 | 4/1987 | European Pat. Off. | 36/29 |
| 3108359 | 10/1982 | Fed. Rep. of Germany | 36/32 R |
| 3228017 | 7/1983 | Fed. Rep. of Germany | 36/3 R |
| 1511344 | 12/1967 | France | 36/43 |
| 200972/6 | 6/1983 | German Democratic Rep. | 36/43 |
| 643119 | 9/1950 | United Kingdom | 36/14 |

*Primary Examiner*—James Kee Chi

*Attorney, Agent, or Firm*—Baker, Mills & Glast

[57] ABSTRACT

A midsole (10 and 32) for heeled shoe (12) comprises a removable insert (10), a peripheral heel member (26) and a peripheral midsole member (32). The peripheral heel member (26) is joined to a portion of the perimeter of an upper surface (20) of an outsole (14) and peripheral midsole member (32) is joined to the remaining portion of upper surface (20) of outsole (14) and to an upper leveling surface (30) of heel member (26) to form a stepped orifice (38). A reinforcing layer (40) substantially less thick than the peripheral members (26 and 32) is joined to the outsole upper surface (20) within the orifice (38). A plurality of independent cushioning elements (46, 48 and 50) depend from a base member (44) of insert (10), and are sized in order to conform to the stepped orifice (38).

23 Claims, 2 Drawing Sheets

CUSTOM MIDSOLE FOR HEELED SHOES

RELATED APPLICATION

This application is a continuation-in-part of co-pending U.S. application Ser. No. 153,222 filed Feb. 8, 1988 which is a continuation in-part of U.S. application Ser. No. 25,010 filed Mar. 12, 1987, which issued as U.S. Pat. No. 4,733,483 on Mar. 29, 1988 and is related to U.S. application Ser. No. 097,806 filed Sept. 17, 1987, (now abandoned) which was a divisional of U.S. Pat. No. 4,733,483.

TECHNICAL FIELD OF THE INVENTION

This invention relates in general to shoes, and more particularly to heeled shoes having custom midsoles.

BACKGROUND OF THE INVENTION

Heeled shoes of a conventional construction generally have three or four separate parts. First, such shoes are provided with an outsole that is made of a durable material and that extends across the lower surface of the shoe. A heel is added to the lower surface of the outsole. In activewear shoes, a midsole may be joined to the outsole to provide a cushioning layer to the wearer's foot. Usually, an upper formed of leather, synthetics or other materials is joined to the midsole. In many conventional structures, an insole is provided instead of or in addition to the midsole, the insole disposed between the midsole and the wearer s foot for additional cushioning.

The midsoles of conventional constructions have two undesirable characteristics. First, they have the property of deforming over a large area of surface when a downward force is impressed on them. Second, the midsoles are affixed to the shoes and therefore customers can make no choice in the midsole s cushionability without selecting another shoe. Thus, conventional midsoles do not offer anything in the way of independent suspension or deformation of various areas thereof, and further are suited to only a particular weight class or cushionability preference of wearers.

The need for a midsole with a plurality of independent cushioning elements and with selectability according to the preference of the wearer has generally been met by the custom midsole disclosed in U.S. Pat. No. 4,733,483, Mar. 29, 1988, to Lin. However, the midsoles disclosed therein were designed to fit a generally flat soled shoe without a heel such as in athletic shoes. Thus there is a need for a custom midsole that is adaptable to a heeled shoe.

SUMMARY OF THE INVENTION

The present invention comprises a shoe with a stepped heel having an outsole with an upper surface. A peripheral heel member is joined to the upper surface of the outsole to provide a flat surface for a peripheral midsole member which is joined to the flat surface, and further forms an orifice stepped in conformance with the heel for matching a stepped insert. The peripheral portions and the stepped insert are formed of a cushionable material. The insert is preferably formed to be laterally coextensive with the area on which most of the weight of the wearer's foot is received. The insert has a preselected cushionability. The selected insert is inserted into the orifice, thus providing a custom midsole that is optimum for the customer's weight or cushioning preferences. An upper is joined to the peripheral midsole member.

Another aspect of the invention comprises a midsole having a stepped insert and a peripheral member disposed laterally outwardly of the insert. The insert has a lower stepped surface with a plurality of convex cushioning elements formed to substantially fill at least a major portion of the insert lower surface. The elements are each operable to cushionably and independently deform responsive to downward force thereon. In a preferred embodiment, the upper surface of the midsole is joined to a fabric layer, which can be constructed of a flocking material, such as can be made from polyester and nylon.

In another aspect of the invention, the insert can be integrally formed with an insole member, the insole surface extending laterally over the peripheral member of the midsole.

A footbed reinforcing layer may be affixed to the bottom of the orifice prior to placing the insert therein. The footbed reinforcing layer is preferably much thinner than the depth of the orifice and provides torsional strength for lateral support of the wearer's foot.

BRIEF DESCRIPTION OF THE DRAWINGS

Various aspects of the invention and their advantages will be more completely understood by reference to the following Detailed Description in conjunction with the appended Drawings in which.

DETAILED DESCRIPTION

Figure 1:
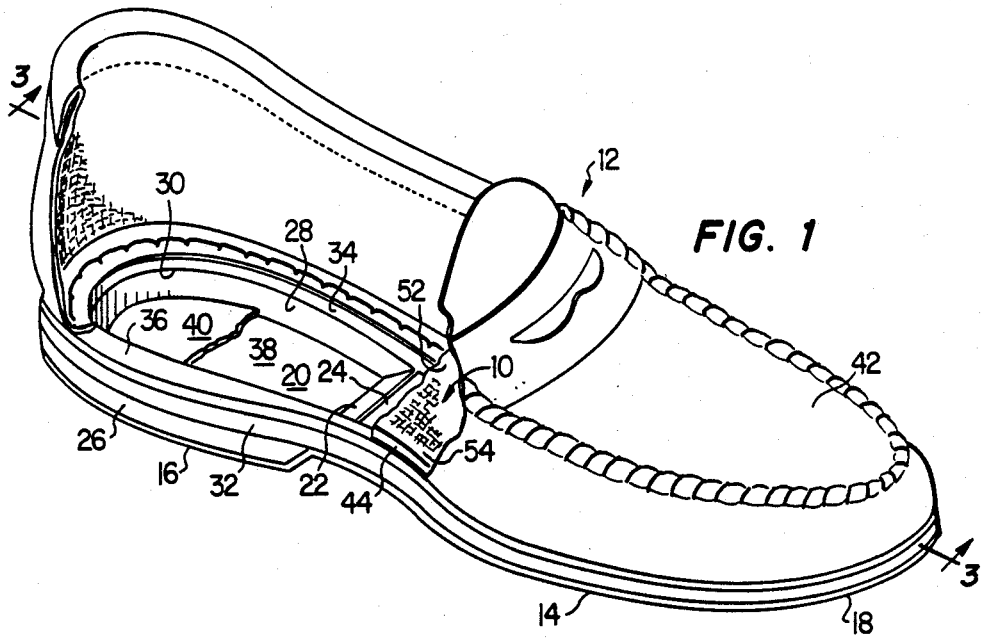
FIG. 1 is an isometric view of a heeled shoe construction according to the invention as fitted with a custom midsole therefor, with parts broken away to show interior structure.

Referring first to FIG. 1, a partially cut-away isometric view of a preferred embodiment of a heeled shoe construction in accordance with the present invention is shown. A custom midsole stepped insert is indicated generally at 10. Stepped insert 10 is shown as fitted into a leisure wear shoe indicated generally at 12. While the illustrated shoe 12 is one designed for leisure wear, the invention can also be employed in other types of heeled shoes, such as work and dress shoes.

Shoe 12 is comprised of an outsole 14 that forms the wearing surface of the shoe. Outsole 14 is preferably constructed of a relatively durable, resilient material such as natural rubber. Outsole 14 has a heel portion 16 and a front portion 18. Outsole 14 has a lower exterior surface (not shown) that may be relatively smooth or may be provided with a suitable tread surface. Outsole 14 further has an interior or upper surface 20. Upper surface 20 may be smooth and featureless throughout, or may be reticulated or webbed in order to save weight. Upper surface 20 has a sloped portion 22 at the transition from the heel portion 16 to the front portion 18 forming a step 24. Sloped portion 22 can in alternative embodiments be replaced with a vertical portion. A peripheral area (not shown) of upper surface 20 presents a smooth surface for gluing or other means of attachment.

A peripheral heel member 26 is formed to be glued or otherwise attached to the peripheral area of outsole upper surface 20 adjacent heel portion 16. Peripheral heel member 26 is more cushionable and yieldable than outsole 14, and can be conveniently molded of polyurethane foam or ethylene vinyl acetate copolymer (EVA). Peripheral heel member 26 is provided as a surface for leveling subsequent peripheral members as will be described more fully below. Peripheral heel member 26 has an interior sidewall 28 and an upper leveling surface 30.

A peripheral midsole member 32 is formed to be glued or otherwise attached to the peripheral area of outsole upper surface 20 adjacent front portion 18 and to upper leveling surface 30. Peripheral midsole member 32 may be formed from the same materials as peripheral heel member 26. Peripheral midsole member 32 is, for example, endless and has an interior sidewall 34 and an upper surface 36. Midsole member 32 in combination with heel member 26 defines a central stepped orifice 38 dimensioned for receiving stepped insert 10.

While in the illustrated embodiment peripheral member 32 is endless, this need not necessarily be the case. Member 32 can, for example, take the form of two longitudinal strips, one for each side of the shoe, or could take the form of several sections spaced around the periphery of the shoe. The form taken by peripheral member 32 should in any event perform its dual function of retaining insert 10 and providing structural support and cushioning for the peripheral area of the shoe. Although not shown, it is to be understood that midsole member 32 and heel member 26 could also be formed integrally. However formed, members 26 and 32 and insert 10 are combined to form a midsole peripheral member.

A footbed reinforcing layer 40 may be affixed as by gluing to outsole upper surface 20 within orifice 38 and to upper surface 36 of midsole member 32. Layer 40 is preferably much thinner than the depth of central orifice 38 so as to allow room for insert 10. Reinforcing layer 40 is sized to substantially coincide with the bottom area of orifice 38 but may be omitted from sloped portion 22.

Layer 40 is fabricated of a relatively resilient, firm, and less flexible material in relation to the EVA forming peripheral members 26 and 32. For example, layer 40 can be constructed of a leatherized paper or cardboard. The purpose of layer 40 is to replace torsional strength lost by the creation of orifice 38 by peripheral members 26 and 32. Thus, a midsole/outsole configuration having satisfactory torsional strength is formed for proper lateral support of the wearer's foot while at the same time providing for a central insert 10 having selectable cushionability.

Shoe 12 further comprises an upper 42 that may be fashioned of leather, cloth, synthetic materials or a combination of these, and is attached to upper surface 36 of peripheral midsole member 32 by any appropriate method such as stitching.

Insert 10 comprises an upper base member 44 and a plurality of supporting elements 46, 48 and 50 (FIG. 2) that are preferably formed integrally with base member 44 to depend therefrom. Elements 46, 48 and 50 occupy stepped orifice 38 when insert 10 is inserted into shoe 12. Elements 46, 48 and 50 are dimensioned such that their depth matches the depth of sidewall 34 adjacent front portion 18 and of sidewall 34 plus sidewall 28 adjacent heel portion 16, minus the thickness of layer 40, and are formed so as to occupy substantially all of orifice 38. Peripheral members 26 and 32 and removable insert 10 are preferably apportioned such that most of the weight of the wearer will be borne by insert 10.

Base member 44 has an upper surface 52. A flocking material 54, which is preferably formed of a polyester/-nylon material but may be formed of any suitable fabric, is joined as by gluing to upper surface 52. As finished out by flocking material 54, insert 10 would not require any additional insole or liner to be suitable for wearing.

As shown, base member 44 has a central area 56, and a lip area 58 (FIG. 2) that extends beyond central area 56. Cushioning elements 46, 48 and 50 depend from central area 56. Lip area 58 is formed to be coextensive with upper surface 36 of peripheral midsole member 32. A uniform cushionable upper surface 52 is therefore presented to the wearer's foot throughout the interior of the shoe.

Figure 2:
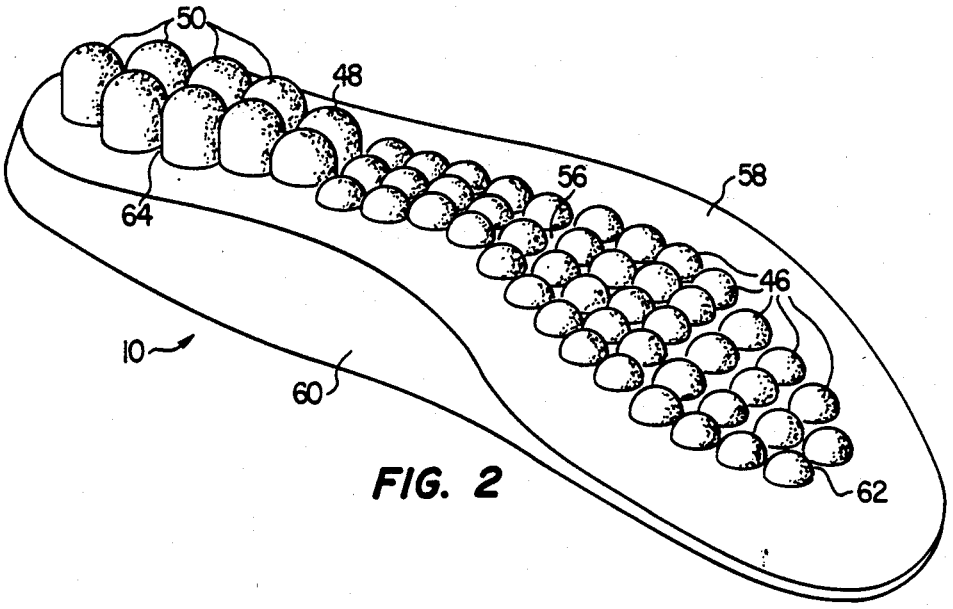
FIG. 2 is a bottom isometric view of a preferred embodiment of a custom midsole insert of the invention.

Referring now to FIG. 2, a bottom isometric view of insert 10 is shown. In the illustrated embodiment, insert 10 is integrally formed with an insole portion 60. In the embodiment shown in FIG. 2, upper surface 52 comprises the upper surface of insole portion 60, and the flocking material 54 (FIG. 1) is joined to this surface.

In the embodiment illustrated in FIGS. 1 and 2, elements 46, 48 and 50 each take the form of a pillar with a rounded free end. The preferred rounded pillar shape of the elements 46, 48 and 50 may be replaced with other shapes, such as triangular prisms, square prisms, octagonal prisms, pyramids or other geometries. Elements 46, 48 and 50 are formed in central area 56 in a closest packing arrangement in order to provide cushionable support throughout central area 56. Elements 46, 48 and 50 are preferably formed independently of each other, and are only joined to base 44. In this manner, elements 46, 48 and 50 provide a multiple-point independent suspension. This is because elements 46, 48 and 50 will be compressed and will yield independently o each other. This is an advantage over midsoles or insoles of solid construction, which have a tendency to yield and compress continuously and uniformly over large areas. The discrete elements 46, 48 and 50 on the other hand give an independent, discontinuous support to different portions of the foot that is not obtainable by a midsole or insole of uniform construction. In a less preferred embodiment, any portion of elements 46, 48 and 50, or all of them, could be replaced by a continuous solid piece of cushionable material that occupies approximately the same volume as the replaced elements.

It is an important aspect of the present invention that elements 46, 48 and 50 are graduated in length in order to conform to the depth of stepped orifice 38 (FIG. 1). In the front portion 62 of area 56, shortest elements 46 are formed. Elements 46 will conform to the relatively thin depth of peripheral midsole member 32 in the front region. In heel portion 64, a number of longest heel cushioning elements 50 are formed. Longest elements 50 adapt to the depth of peripheral heel member 26 plus peripheral midsole member 32. Further, since there is a larger cushioning depth of material, the elements 50 have a larger radius than elements 46 to prevent undue bending or deformation, as might otherwise occur if a plurality of long, thin elements were used. Middle sized elements 48 are positioned between elements 46 and 50 to compensate for the step 24 formed by sloped portion 22.

Figure 3:
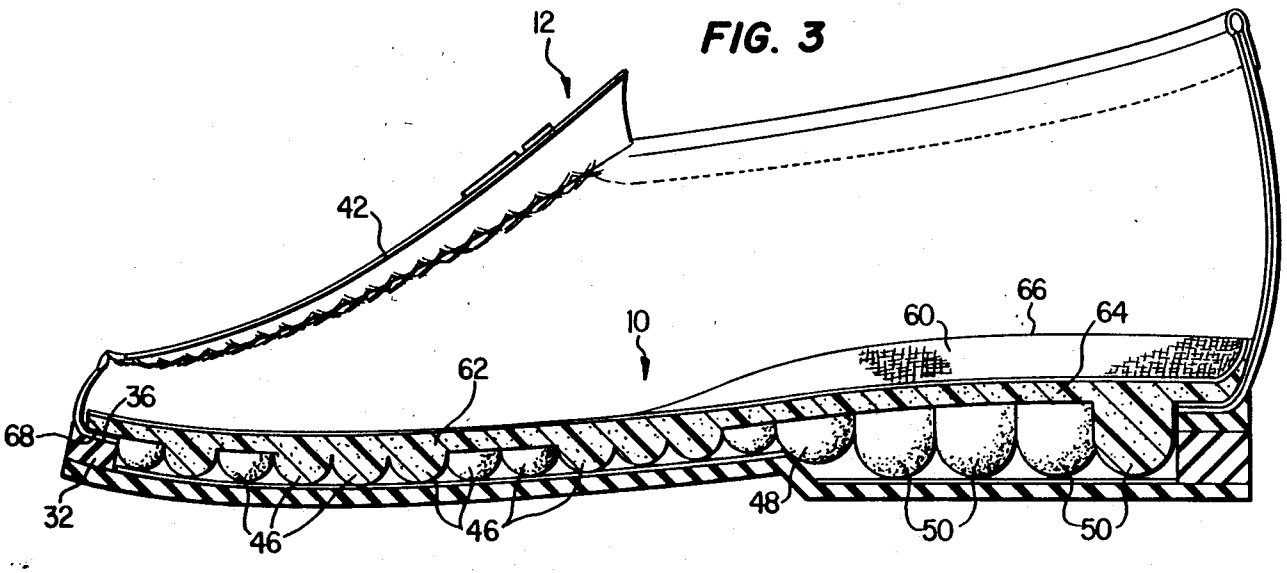
FIG. 3 is a longitudinal section taken substantially along line 3—3 of FIG. 1.

Referring now to FIG. 3, an elevational section taken substantially along line 3—3 of FIG. 1 is shown. FIG. 3 particularly illustrates the graduated length and radius of elements 46, 48 and 50 from front portion 62 to heel portion 64. Some of the elements 46 and 50 are not shown in section because section line 3—3 did not pass through them, or are shown only partially in section because line 3—3 did not pass through them along their major diameter. Insole portion 60 is shown to have a concave surface 66 in heel portion 64 for the support of the heel of the wearer's foot.

Upper 42 has a bottom lip member 68 for mating with upper surface 36 of peripheral midsole member 32. Lip member 68 is attached as by gluing to upper surface 36. Stitching, not shown, may be used to join lip member 68 and peripheral midsole member 32, and optionally outsole 14, together.

In a preferred operation, shoes 12 and inserts 10 are distributed to retailers as separate items. Each insert 10 has a specific durometer reading that measures its relative yieldability or resiliency. The cushionability of inserts 10 can also be varied by changing the shape and/or spacing of elements 46, 48 and 50. A plurality of different inserts 10 having a range of durometer readings are provided for each shoe size, such that any pair of numerous pairs of inserts 10 can be inserted into a respective pair of shoes 12. A particular pair of inserts 10 are selected for a particular customer according to the customer's weight and cushioning preference. Thus, a lightweight person will in general require an insert 10 that is more cushionable and less resilient than a heavier person. Further, the customer may have a particular preference concerning how "soft" or "hard" the shoe feels, and may select a pair of inserts 10 that match his or her preferences in this respect. Finally, there may be medical reasons for selecting an insert 10 for the right shoe that has a different resiliency and cushionability than an insert 10 for the left shoe, and the invention will permit this selection.

In summary, a novel midsole with a custom stepped insert has been provided in order to vary the resiliency and cushionability of the midsole according to the wearer's needs in a heeled shoe. An insert of the midsole preferably has a plurality of various-length depending elements that provide an independent cushioning suspension.

While preferred embodiments of the invention and their advantages have been described above, the invention is not limited thereto but only by the spirit and scope of the claims which follow.

What is claimed is:

1. A shoe with a stepped heel, comprising:

a durable outsole having an upper surface including a front portion and a heel portion, said heel portion stepped downwardly from said front portion;

a cushionable midsole comprising at least one stepped peripheral portion and a separate, removable stepped insert, a lower surface of said peripheral portion joined to said outsole upper surface, said at least one peripheral portion forming a stepped orifice for receiving said insert;

said removable insert having a plurality of convex cushioning elements configured with a stepped lower surface for disposal substantially adjacent to said outsole upper surface and having a preselected cushionability; and an upper joined to said peripheral portion.

2. The shoe of claim 1, wherein said stepped insert is dimensioned to receive most of the weight transmitted to said midsole by the wearer once said insert is inserted into said stepped orifice.

3. The shoe of claim 1, wherein said peripheral portion is elongate and endless, said peripheral portion laterally enclosing said insert when said insert is inserted into said orifice.

4. The shoe of claim 3, wherein said peripheral portion has an upper surface, a lower lip member of said upper joined to said upper surface of said peripheral portion.

5. The shoe of claim 4, and further comprising:

an elongate endless peripheral liner joined to said lip member of said upper, said lip member disposed between said upper surface of said peripheral portion and said liner.

6. The shoe of claim 1, wherein said insert is formed of polyurethane foam.

7. The shoe of claim 1, and further comprising an insole integrally formed with said insert, said insole extending substantially over said peripheral portion.

8. The shoe of claim 7, wherein an upper surface of said insert is covered with a fabric, said fabric comprising a flocking material comprising polyester and nylon.

9. The shoe of claim 1, further comprising a reinforcing layer joined to said outsole upper surface within said orifice, said reinforcing layer being substantially thinner than the depth of said orifice and providing torsional strength to said outsole, said stepped lower surface of said insert contacting said reinforcing layer when said insert is inserted into said shoe.

10. The shoe of claim 9, wherein said reinforcing layer is substantially less flexible and more resilient than said peripheral portion.

11. The shoe of claim 10, wherein said reinforcing layer comprises leatherized paper or cardboard.

12. The shoe of claim 1, wherein said peripheral portion further comprises:

a peripheral heel member fixed to said heel portion of the outsole upper surface, said peripheral heel member having a top surface; and a peripheral midsole member fixed to said front portion of said outsole upper surface and to said top surface of said heel member.

13. A midsole for disposal above a stepped upper surface of a heeled outsole comprising:

a stepped removable insert of said midsole;

a peripheral member disposed laterally outwardly of said insert to form a stepped orifice; and said insert having a base member for disposal on said peripheral member and a lower stepped portion depending from said base member, said lower portion comprising a plurality of convex cushioning elements having various lengths, said elements each operable to cushionably deform and flatten responsive to a force having a component perpendicular to said insert at said element, each element operable to deform independently of the remaining elements, and said lower portion insertable through said orifice to be disposed substantially adjacent to the stepped upper surface of the outsole.

14. The midsole of claim 13, wherein said stepped orifice comprises a toe portion and a heel portion stepped to be of greater depth than said toe portion, said cushioning elements including a plurality of longest elements for disposal in said heel portion.

15. The midsole of claim 14, wherein said cushioning elements are radially symmetrical.

16. The midsole of claim 15, wherein said lower stepped portion comprises a heel section and a toe section, said cushioning elements of said heel section having a larger radius than said cushioning elements of said toe section.

17. The midsole of claim 15, wherein said cushioning elements are formed as pillars with rounded lower free ends.

18. The midsole of claim 13, wherein said elements are each laterally adjacent a plurality of other elements in a closest-packing arrangement.

19. The midsole of claim 13, wherein said elements are arranged in transverse rows.

20. The midsole of claim 13, wherein said base member comprises an insole member formed above said lower portion of said insert and extending laterally to substantially cover said peripheral member.

21. The midsole of claim 13, wherein said removable insert is formed of a cushionable synthetic material, said insert selectable from among a plurality of like inserts having different cushionabilities.

22. The midsole of claim 13, further comprising a reinforcing layer joined to the stepped upper surface of said outsole within said peripheral member and having a thickness substantially less than said peripheral member, said lower portion of said insert contacting said reinforcing layer when said insert is inserted into said orifice.

23. The midsole of claim 13, wherein said heeled outside comprises a toe portion and a heel portion stepped downwardly from said toe portion, said peripheral member including a peripheral heel member fixed to said upper surface of said heel portion of said outsole, said heel member having a top surface; and a peripheral midsole member fixed to the upper surface of said toe portion of said outsole and to said top surface of said heel member.

* * * * *

UNITED STATES PATENT AND TRADEMARK OFFICE

CERTIFICATE OF CORRECTION

PATENT NO. : 4,908,962

DATED : March 20, 1990

INVENTOR(S) : Lin Yung-Mao

It is certified that error appears in the above-identified patent and that said Letters Patent is hereby corrected as shown below:

IN THE CLAIMS

Claim 23, column 8, line 11, change "outside" to --outsole--.

Signed and Sealed this

Eighteenth Day of June, 1991

*Attest:*

*Attesting Officer*

HARRY F. MANBECK, JR.

*Commissioner of Patents and Trademarks*